US005363351A

United States Patent [19]

Carney

[11] Patent Number: 5,363,351

[45] Date of Patent: Nov. 8, 1994

[54] WATCHBAND ADAPTOR FITTING FOR A WRISTWATCH CASING

[75] Inventor: Peter L. Carney, London, England

[73] Assignee: Chisco, Inc., Salt Lake City, Utah

[21] Appl. No.: 84,736

[22] Filed: Jun. 29, 1993

[51] Int. Cl.[5] ..... G04B 37/00; A44C 5/18

[52] U.S. Cl. ..... 368/282; 24/265 WS; 224/164

[58] Field of Search ..... 368/281–282; 24/265 B, 265 WS, 230 R, 230 AK, 230 AL; 224/164–180

[56] References Cited

U.S. PATENT DOCUMENTS

| | | | |
|---|---|---|---|
| Re. 28,793 | 5/1976 | Bert | 24/265 B |
| 2,653,369 | 9/1953 | Roriguez . | |
| 3,740,804 | 6/1973 | Levinger | 24/265 WS |
| 3,889,323 | 6/1975 | Reith | 24/265 B |
| 3,897,612 | 8/1975 | Bert | 24/265 B |
| 4,217,681 | 8/1980 | Grohoski et al. | 24/265 WS |
| 4,355,501 | 10/1982 | Tesch . | |
| 4,414,719 | 11/1983 | Capolupo | 24/265 WS |
| 4,561,077 | 12/1985 | Mock et al. | 368/282 |
| 4,624,581 | 11/1986 | Mock et al. . | |
| 4,722,179 | 2/1988 | Tesch . | |
| 4,763,313 | 8/1988 | Greer et al. . | |
| 4,936,019 | 6/1990 | Hirsch . | |
| 4,987,655 | 1/1991 | Bert . | |

*Primary Examiner*—Vit W. Miska
*Attorney, Agent, or Firm*—Julie K. Morriss

[57] ABSTRACT

An adaptor attachable to the watch casing of a watch is structured with attachment means for being secured to the watchband securement means of the watch casing, and is further structured with watchband retaining structure which allows attachment of a watchband by means different than is provided on the watch casing. Thus, the watch casing may be converted for use with watchbands which are not configured to be attachable to that particular watch casing. Likewise, conventional watches employing pin means for attachment of the watchband may be converted to attach uniquely designed watchbands configured for attachment only to correspondingly unique watch casings.

13 Claims, 3 Drawing Sheets

WATCHBAND ADAPTOR FITTING FOR A WRISTWATCH CASING

TECHNICAL FIELD

This invention relates to wristwatches and specifically relates to an adaptor structure attachable to the casing of a wristwatch to thereby modify the structure of the casing to accommodate watchbands having different means of attachment to the casing.

BACKGROUND

Wristwatches are structured with a variety of means for attaching the watchband, that portion which encircles the wrist, to the watch casing. Watch casing, as used herein, refers to that portion which surrounds the face of the watch and which houses the mechanical movement of the watch. All watch casings also provide means, located on either side of the watch face, for attaching the watchband to the casing.

The most conventional means employed in a watch casing for attaching the watchband is a pin positioned between two opposing arm members which extend outwardly from the edge of the casing. In some instances, the pin is stationary and the watchband is looped about the pin and secured upon itself. In such instances, the watchband is a relatively permanent part of the wristwatch and requires more extensive disassembly of the watch to replace the watchband.

In other instances, the pin is either inserted through the extended arms and held in place by screw means, or the pin is spring-biased between the extended arm members. In some embodiments, the pin may be journalled between the extended arm members. In instances where the pin is movable, the watchband is easily removed by either unscrewing the pin from between the arm members or by compressing the spring-biased pin to release it from between the arms. The pin, which is positioned within a loop formed in the watchband, may be removed from the loop and reinserted in another wristband for attachment of the new band to the casing.

Some watch manufacturers have especially designed the casing of the watch to accommodate a reciprocally designed watchband, thereby limiting the types of watchbands which may be used with that particular watch casing. Typically, the watchband and casing are manufactured by the same company. An example of such a reciprocating watch casing and watchband is the "Swatch Watch" ® brand of watch made by the Swatch Company of Switzerland.

Today, the watch manufacturing industry has made an effort to provide the consuming public with a variety of choices as to watch casing styles and watchband styles. For example, the Guess TM watch has been structured to readily allow the removal and replacement of the watchband so that a consumer may simply change the watchband to suit different clothing styles, different moods, or different color choices.

Recognizing the consumer's desire to exploit the ways and manners in which a wristwatch may be worn, U.S. Pat. No. 4,763,313 to Greer, issued Aug. 9, 1988, discloses a carrier into which a watch casing may be positioned to adapt it for wearing in a variety of ways, including as a lapel pin. The U.S. Pat. No. 4,763,313 also discloses an embodiment of the carrier which provides attachment means at either end thereof for supporting a strap. Further, U.S. Pat. No. 4,936,019 to Hirsch, issued Jun. 26, 1990, discloses a template and cutting instrument for modifying a leather or cloth watchband to fit a particularly structured watch casing, such as a Swatch Watch ®.

The patented devices referenced above require either placement of the watch casing into a special carrier to adapt it to another means of wearing, or require the destruction of an existing watchband in order to adapt it to that particular watch casing. Such devices, therefore, require a great deal of manipulation or modification and inconvenience to adapt the casing to receive different styles of watchbands suitable to the wearer's liking.

Thus, it would be advantageous in the watch art to provide an adaptor structure which quickly and simply attaches to the watchband securement means of a watch casing to convert the casing from its original design structure for attaching the watchband to a completely different means for attaching a watchband so that a variety of different watchband styles may be used with the watch casing.

DISCLOSURE OF THE INVENTION

In accordance with the present invention, an adaptor structure is provided which attaches to the watchband securement means of a watch casing to convert the watchband securement means from its original structure to an alternative structure to support the attachment of a different type or style of watchband to the watch casing. Although the present invention is adaptable to any design or configuration of watchband securement means attendant to a watch casing, the present invention is illustrated herein as attachable to a "Swatch Watch" ® design as an exemplar.

The present invention comprises an adaptor structure having attachment structure for securing the adaptor to the watchband securement means of a watch casing, and further comprises watchband retaining structure for retaining a watchband in proximity to the adaptor structure and watch casing.

The attachment structure of the invention is configured to articulate with the particular watchband securement means of the watch casing. That is, in the case of a "Swatch Watch" ® the watchband securement means of the watch casing may be configured with two outer arm members extending away from the watch casing and at least two additional arm members extending outwardly from the watch casing in parallel orientation to the outer arm members and spaced between the outer arm members. Thus, the attachment structure of the invention, in an embodiment adaptable to a "Swatch Watch" ® comprises a complimentary number of extending arm members which are consecutively located between the extending arm members of the watch casing, and which articulate with the arm members of the watch casing about a common pivot point.

Alternatively, if the adaptor of the invention is used in connection with a more conventionally structured watch casing, e.g. one having a spring-biased pin mounted between two outer arm members extending outwardly from the watch casing, the attachment structure may comprise a barrel sized to be receivable between the arm members of the watch casing and structured to be securable between the arm members. From the foregoing examples, therefore, it is easily understood that the attachment structure of the invention comprises a structure which reciprocates and/or articulates with the particular design or configuration of watchband securement means of the watch casing.

The watchband retaining structure of the invention provides means for attaching a watchband to the adaptor, and thus to the watch casing. The watchband retaining structure is particularly designed or configured to provide structure which allows the attachment of a watchband to the adaptor which is of a different type or style than the watchband which originally accompanied the watch casing at time of purchase. Thus, in the case of an adaptor structured to be attachable to a "Swatch Watch" ® the watchband retaining structure of the invention would be a pin positioned between two outer arm members. In the case of an adaptor configured to be attachable to a conventional type watch casing having a pin as the watchband securement means, the watchband retaining means of the invention might be a plurality of extending arm members which are configured and numbered to articulate with the extending arm members of a "Swatch Watch" ® watchband.

The adaptor structure of the present invention may be constructed of any suitable material, including hardened plastics, polymers, stainless steel, aluminum or the like. The adaptor of the invention may comprise any suitable size or dimension commensurate with the size and dimension of the particular watch casing with which it is to be used.

BRIEF DESCRIPTION OF THE DRAWINGS

In the drawings, which illustrate what is currently considered to be the best mode of the invention.

BEST MODE OF THE INVENTION

Figure 1:
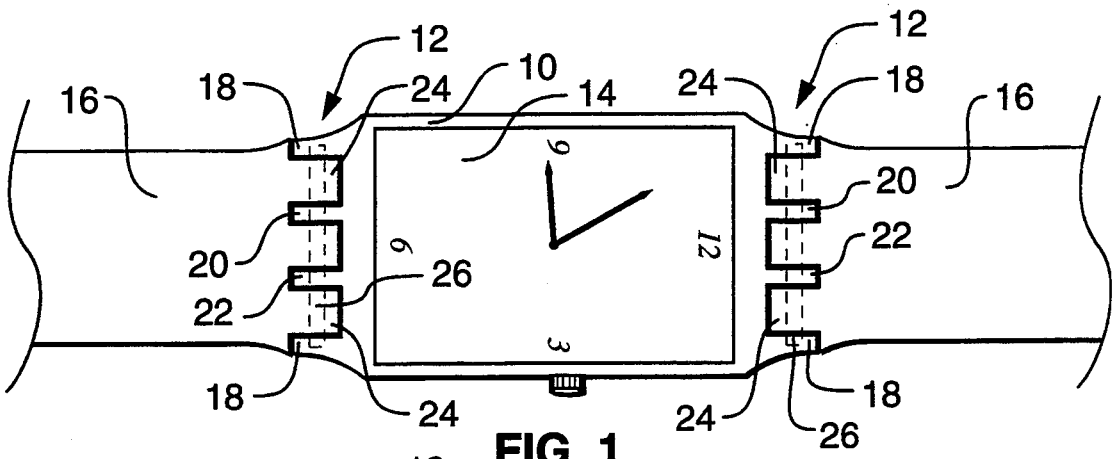
FIG. 1 is a plan view of a prior art watch casing and watchband illustrated for comparison purposes.

The present invention is directed to adapting the watchband securement means of an existing watch casing to enable attachment of a different type or style of watchband to the watch casing. As illustrated in FIG. 1, each watch casing 10 is structured with watchband securement means 12, positioned on either side of the face 14 of the watch casing 10, for attaching a watchband 16 to the watch casing 10.

FIG. 1 illustrates an example of a particularly designed watch casing 10, the watchband securement means 12 of which comprises two outer arm members 18 extending out from the watch casing 10 and two other arm members 20, 22 which extend outwardly from the watch casing 10 in parallel orientation to the outer arm members 18 and which are positioned therebetween. The watchband 16 designed to accompany the watch casing 10 is structured with reciprocating and articulating arm members 24 which customize the watchband 16 to that uniquely structured watch casing 10. The arm members 24 of the watchband 16 are maintained in secure attachment to the watch casing 10 by insertion of a pin 26 or similar means through the adjacent arm members 20, 22, 24 and outer arm members 18, as shown.

Figure 2:
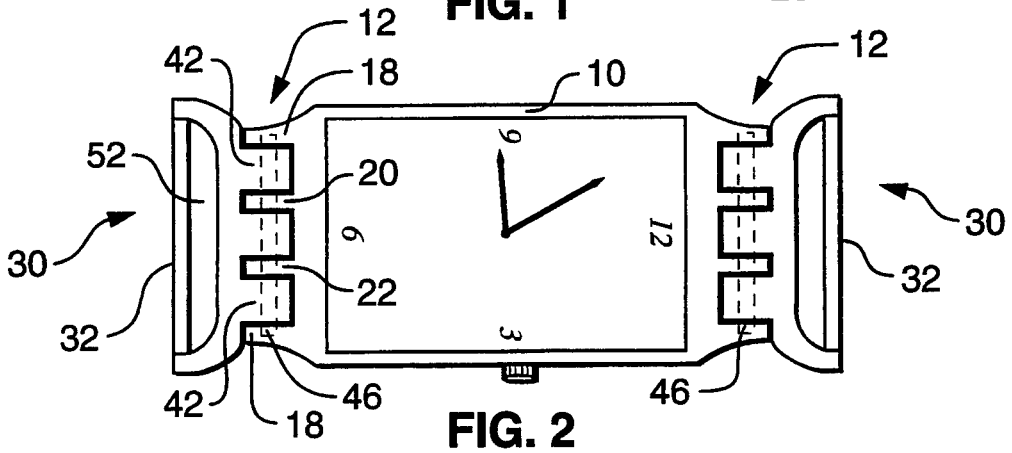
FIG. 2 is a plan view of the watch casing shown in FIG. 1 having a first embodiment of the invention attached to the watchband securement means of the watch casing.
Figure 3:
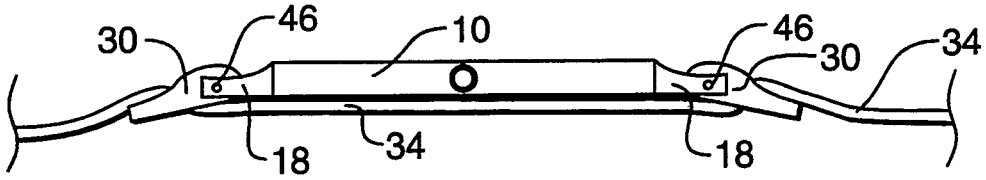
FIG. 3 is a side view of the embodiment shown in FIG. 2 illustrating the positioning of a watchband through the adaptor structure of the invention.
Figure 4:
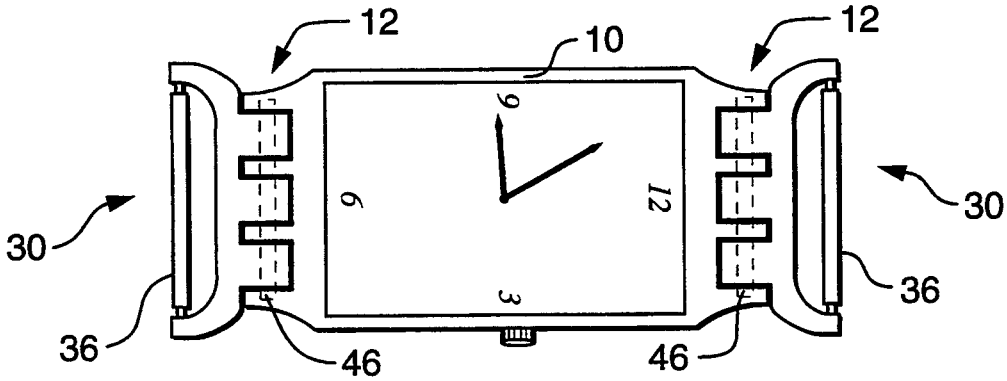
FIG. 4 is a plan view of the watch casing shown in FIG. 1 and having an alternative embodiment of the invention attached to the watchband securement means of the watch casing.
Figure 5:
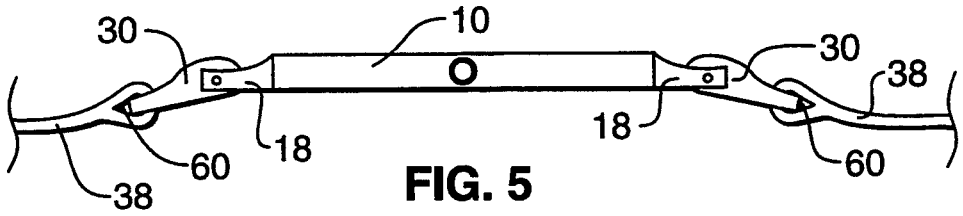
FIG. 5 is a side view of the embodiment shown in FIG. 4 illustrating attachment of a watchband to the adaptor structure of the invention.

FIG. 2 generally illustrates adaptor structure 30 of the present invention attached to the watchband securement means 12 of the watch casing 10 shown in FIG. 1. The adaptor structure 30 provides a means for converting the watchband securement means 12 of the watch casing into a different type or style of watchband securement means, shown here as a pin 32, so that a different type of watchband 34 can be attached to the watch casing 10. FIG. 3 illustrates how the adaptor 30, attached to the watch casing 10, has enabled a continuous strap-type watchband 34 to be used with the watch casing 10. In a similar, but alternative embodiment of the adaptor structure 30, as shown in FIGS. 4 and 5, the watch casing 10 is modified through the adaptor 30 to have a spring-biased pin 36 which allows attachment of a conventional two-piece, loop ended watchband 38.

Figure 6:
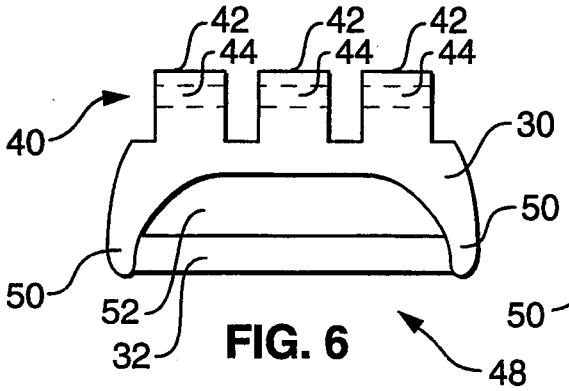
FIG. 6 is an enlarged plan view of the embodiment of the invention shown in FIG. 2.
Figure 11:
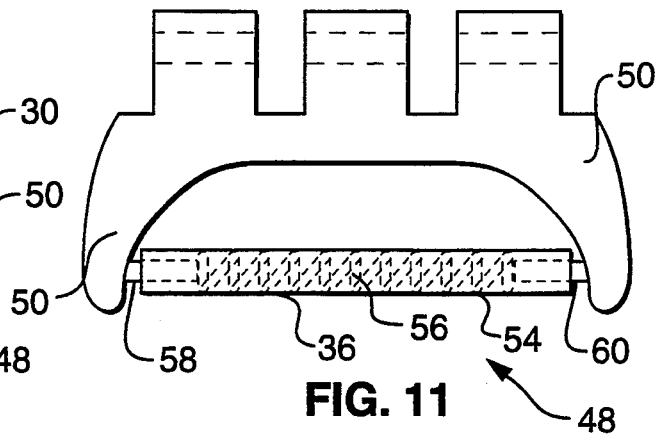
FIG. 11 is a plan view of the alternative embodiment shown in FIG. 4.
Figure 7:
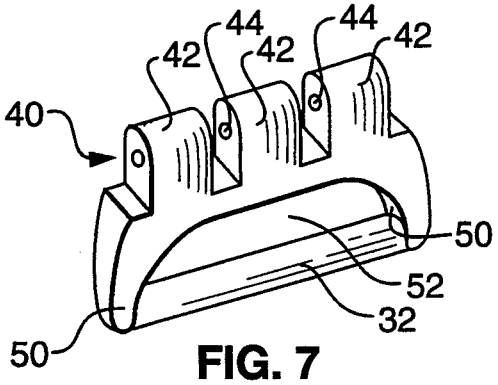
FIG. 7 is a perspective view of the embodiment shown in FIG. 6.
Figure 12:
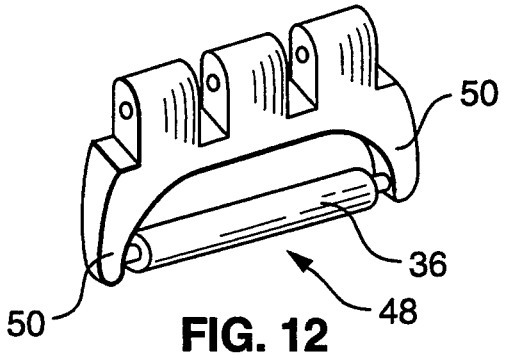
FIG. 12 is a perspective view of the alternative embodiment shown in FIG. 4.
Figure 8:
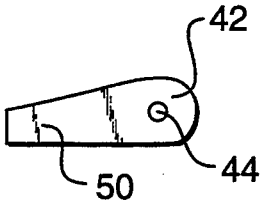
FIG. 8 is a side view of the invention.
Figure 9:
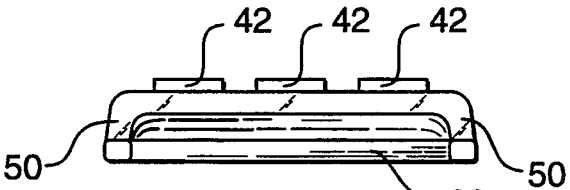
FIG. 9 is a front view of the embodiment shown in FIG. 6.
Figure 10:
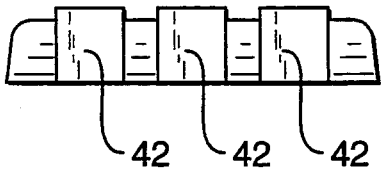
FIG. 10 is a rear view of the embodiment shown in FIG. 7.

The structure of the embodiment of the invention shown in FIG. 2 is more readily understood by reference to FIGS. 6–10. The adaptor 30 generally comprises attachment structure 40 configured to articulate with and secure the adaptor 30 to the watchband securement means of a watch casing. As illustrated in FIGS. 2, 6 and 7, the attachment structure 40 may comprise arm members 42 which are in sufficient number, and which are sized, to be positionable between reciprocating arm members 20, 22 of a watch casing 10. The arm members 42 of the adaptor 30 are positioned adjacent to and between the arm members 20, 22 of the watch casing 10 and articulate with the arm members 20, 22 of the casing 10 about a pivot point, as shown in FIG. 2.

The attachment structure 40 of the invention is configured with means for securing the adaptor 30 to the watchband securement means 12 of the watch casing 10. Thus, as illustrated, the arm members 42 of the adaptor 30 may have apertures 44 formed therethrough, and each aperture 44 is in alignment with the aperture 44 of an adjacent arm member 42, to provide a channel through which a pin 46 may be inserted to secure the adaptor to the outer arm members 18 of the watch casing 10.

The adaptor 30 also comprises watchband retaining structure 48 for providing attachment of a watchband to the adaptor 30, and thus to the watch casing 10. As illustrated in FIGS. 2, 6 and 7, the watchband retaining structure 48 may be a pin 32 unitarily formed with the adaptor 30 and positioned between opposing, aligned bearing extensions 50 which are associated with the attachment structure 40. The pin 32 of the embodiment illustrated in FIGS. 2, 6, 7 and 9 is permanently secured as part of the adaptor 30, and therefore provides for attachment of a continuous-strap watchband 34 by threading the watchband 34 through the opening 52 formed between the attachment structure 40 and the pin 32, as shown in FIG. 3. Alternatively, a watchband having formable loops at the ends of interlocking strap members may be enfolded about the pin 32 to attach the watchband to the adaptor 30.

An alternative watchband retaining structure 48 is illustrated in FIGS. 4, 5, 11 and 12, where a spring-biased pin 36 is positioned between bearing extensions 50 of the adaptor 30. As more clearly shown in FIG. 11, the spring-biased pin 36 may comprise a hollow tube 54 in which is positioned a spring 56 (shown in phantom) which bears against a shaft 58 slidably positioned within one end of the hollow tube 54. The spring-biased pin 36 may be removed from the adaptor 30 by applying pressure to the hollow tube 54 thereby compressing the spring 56 and allowing disengagement of the end 60 of the hollow tube 54 from the bearing extension 50. The spring-biased pin 36 may then be positioned through a formed loop 62 at the end of a watchband 38, as shown in FIG. 5, and the spring-biased pin 36 replaced in position between the bearing extensions 50.

The embodiments of the invention described heretofore illustrate a means for converting the watch casing of a uniquely designed watch, such as a "Swatch Watch" ® to accommodate a different, and more conventional, type or style of watchband, namely one which attaches to the watch casing by pin means. However, it may be desirous to adapt a conventional watch casing configured with a pin-type watch securement means to accommodate a uniquely configured watchband, such as one designed to particularly fit a "Swatch Watch" ®. Accordingly, the alternative embodiment of the invention shown in FIGS. 13–15 illustrate such adaptability.

Figure 13:
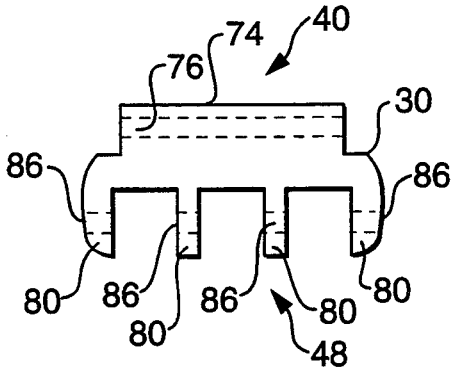
FIG. 13 is a plan view of another alternative embodiment of the invention.
Figure 14:
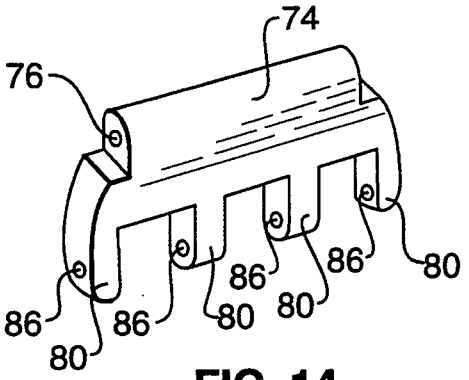
FIG. 14 is a perspective view of the embodiment shown in FIG. 13.
Figure 15:
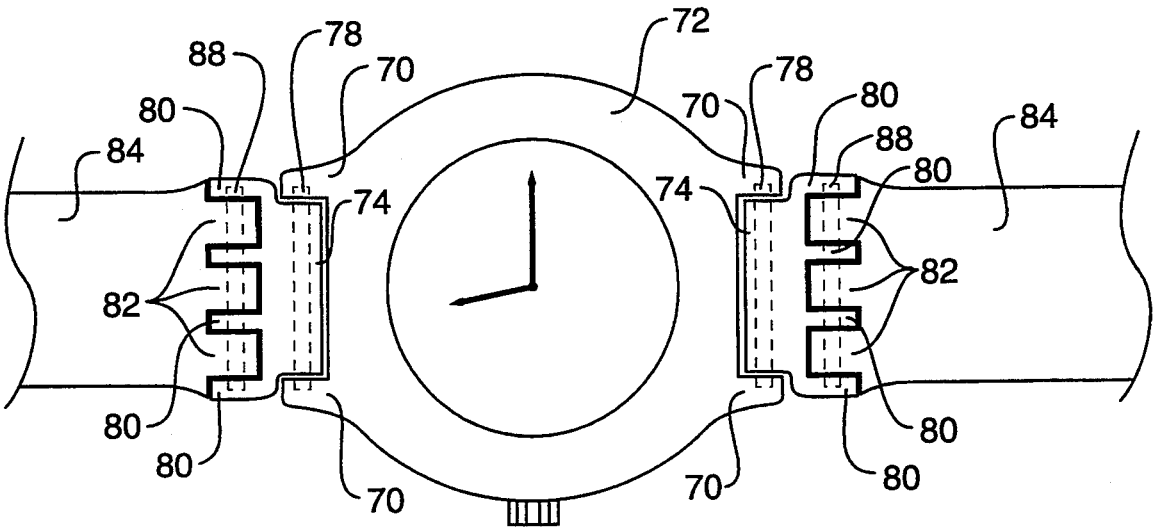
FIG. 15 is a plan view of a watch casing illustrating attachment of the embodiment of the invention shown in FIGS. 13 and 14 converting the casing to provide for attachment of a differently structured watchband.

The adaptor 30 shown in FIGS. 13–15 has attachment structure 40 which is sized in dimension to fit between and articulate with the pin holding extensions 70 of a watch casing 72, the watchband securement means of which comprises a conventional pin structure. Thus, the attachment structure 40 may be an elongated barrel 74 having a channel 76 formed through its length to allow placement of the watchpin 78 therethrough to secure the adaptor 30 between the pin holding extensions 70. Alternatively, the attachment structure 40 may be a shaft having spring-biased pins positioned at either end thereof sized to bear against the pin holding extensions 70 of the watch casing 72 to be securely biased therebetween.

Secured to the attachment structure 40 of the adaptor 30 is the watchband retaining structure 48, which here comprises a plurality of arm members 80 which correspond in complimentary number and dimension to the reciprocating arm members 82 of a watchband 84. Each arm member 80 of the adaptor 30 has an aperture 86 formed therethrough which aligns with the aperture 86 of adjacent arm members 80 to form a channel through which a pin 88 may be positioned to secure the watchband 84 to the arm members 80 of the adaptor 30. Thus, a conventional wristwatch casing employing a pin watchband securement means can be converted with the adaptor 30 of the invention to support attachment of a differently configured watchband.

The present invention provides adaptor structure securable to the watch casing of a wristwatch to convert the watchband securement means of the watch casing to a different type or style of watchband securement means. The adaptor structure may be configured to fit any type of watchband securement means employed in any particular watch casing style, and the watchband retaining structure of the adaptor may comprise any number of means for attaching a watchband which is different than that means employed in the watch casing. Thus, reference herein to specific details of the illustrated embodiments is by way of example and not by way of limitation. It will be apparent to those skilled in the art that many modifications of the basic illustrated embodiments may be made without departing from the spirit and scope of the invention as recited by the claims.

What is claimed is:

1. Adaptor structure for attachment to the watch casing of a wristwatch comprising:

attachment structure configured to be positionable relative to, and securable to, the watchband securement means of a watch casing of a wristwatch; and watchband retaining structure attached to said attachment structure, said watchband retaining structure providing a different means of attaching a watchband thereto than is provided by said watchband securement means of said watch casing, said watchband retaining structure being configured to provide pivotal articulation of said watchband thereabout.

2. The adaptor structure of claim 1 wherein said attachment structure comprises a plurality of arm members which are sized in dimension, and exist in complimentary number, to correspond with reciprocating arm members of a watch casing, said arm members of said attachment structure being positionable between said arm members of said watch casing and articulable therewith.

3. The adaptor structure of claim 2 wherein said watchband retaining structure comprises a pin member unitarily formed with said attachment structure and positioned away from said attachment structure to provide an opening through which the strap of a watchband is positionable.

4. The adaptor structure of claim 2 wherein said watchband retaining structure comprises a spring-biased pin positioned between opposing bearing extensions which extend from said attachment structure, said spring-biased pin being positioned apart from said attachment structure to provide an opening through which a portion of a watchband is positionable, said spring-biased pin further being removable from between said bearing extensions.

5. The adaptor structure of claim 1 wherein said attachment structure comprises a hollow barrel sized to be positionable between the pin bearing extensions of a watch casing having a watchpin biased between said pin bearing extensions, said watchpin being slidably positionable through said hollow barrel to secure said adaptor structure to said pin bearing extensions.

6. The adaptor structure of claim 5 wherein said watchband retaining structure comprises a plurality of arm members sized in dimension and existing in complimentary number to correspond with arm members of a watchband, said arm members of said adaptor structure being positionable between and articulable with said arm members of said watchband, and said arm members of said watchband retaining structure and said watchband each having an aperture formed therethrough and aligned with the apertures of adjacent arm members to provide a channel through which a pin is positionable to secure said watchband to said adaptor structure.

7. The adaptor structure of claim 1 wherein said attachment structure comprises a shaft sized to be positionable between the pin bearing extensions of a watch casing structured to have a watchpin biased between said pin bearing extensions, said shaft having spring-biased pin extensions which are sized to bear against said pin bearing extensions and to be securely biased therebetween.

8. Adaptor structure for attachment to the watch casing of a wristwatch comprising:

attachment structure configured to be positionable relative to, and securable to, the watchband securement means of a watch casing of a wristwatch, said attachment structure comprising a plurality of arm members which are sized in dimension, and exist in complimentary number, to correspond with reciprocating arm members of a watch casing, said arm members of said attachment structure being positionable between said arm members of said watch casing; and watchband retaining structure attached to said attachment structure, said watchband retaining structure providing a different means of attaching a watchband thereto than is provided by said watchband securement means of said watch casing.

9. The adaptor structure of claim 8 wherein said watchband retaining structure comprises a pin member unitarily formed with said attachment structure and positioned away from said attachment structure to provide an opening through which the strap of a watchband is positionable.

10. The adaptor structure of claim 8 wherein said watchband retaining structure comprises a spring-biased pin positioned between opposing bearing extensions which extend from said attachment structure, said spring-biased pin being positioned apart from said attachment structure to provide an opening through which a portion of a watchband is positionable, said spring-biased pin further being removable from between said bearing extensions.

11. Adaptor structure for attachment to the watch casing of a wristwatch comprising:

attachment structure configured as a shaft sized in length to be positionable between the pin bearing extensions of a watch cashing; and watchband retaining structure attached to said attachment structure, said watchband retaining structure comprising a plurality of arm members sized in dimension and existing in complimentary number to correspond with arm members of a watchband, said arm members of said adaptor structure being positionable between and articulable with said arm members of said watchband, and said arm members of said watchband retaining structure and said watchband each having an aperture formed therethrough and aligned with the apertures of adjacent arm members to provide a channel through which a pin is positionable to secure said watchband to said adaptor structure.

12. The adaptor structure of claim 11 wherein said shaft of said attachment structure is a hollow barrel through which a pin which is sized in length to span between said pin bearing extensions is positionable to secure said adaptor to said watch casing.

13. The adaptor structure of claim 11 wherein said shaft of said attachment structure is a pin sized in length to span between said pin bearing extensions of said watch casing and configured to be securable to said pin bearing extensions.

* * * * *